US009227809B2

(12) United States Patent
Tanami et al.

(10) Patent No.: US 9,227,809 B2
(45) Date of Patent: Jan. 5, 2016

(54) CONVEYANCE APPARATUS AND RECORDING APPARATUS

(71) Applicant: CANON KABUSHIKI KAISHA, Tokyo (JP)

(72) Inventors: Haruhiko Tanami, Fuchu (JP); Yuki Igarashi, Tokyo (JP); Ryoya Shinjo, Kawasaki (JP); Ryohei Maruyama, Kawasaki (JP); Shin Genta, Yokohama (JP); Naoki Wakayama, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/933,795

(22) Filed: Jul. 2, 2013

(65) Prior Publication Data

US 2014/0008408 A1 Jan. 9, 2014

(30) Foreign Application Priority Data

Jul. 5, 2012 (JP) ..... 2012-151405

(51) Int. Cl.

| | |
|---|---|
| ***B41J 11/42*** | (2006.01) |
| ***B65H 26/06*** | (2006.01) |
| ***B41J 11/44*** | (2006.01) |
| ***B41J 11/00*** | (2006.01) |
| ***B65H 20/02*** | (2006.01) |
| *B41J 13/00* | (2006.01) |

(52) U.S. Cl.

CPC ..... *B65H 26/06* (2013.01); *B41J 11/0095* (2013.01); *B41J 11/42* (2013.01); *B41J 11/44* (2013.01); *B65H 20/02* (2013.01); *B41J 13/0009* (2013.01); *B65H 2301/5151* (2013.01); *B65H 2404/143* (2013.01); *B65H 2511/114* (2013.01); *B65H 2511/142* (2013.01); *B65H 2511/212* (2013.01); *B65H 2515/31* (2013.01); *B65H 2515/32* (2013.01); *B65H 2701/1311* (2013.01); *B65H 2701/1313* (2013.01); *B65H 2801/09* (2013.01); *B65H 2801/36* (2013.01)

(58) Field of Classification Search

USPC ..... 400/583

See application file for complete search history.

(56) References Cited

U.S. PATENT DOCUMENTS

| | | | | |
|---|---|---|---|---|
| 4,591,969 | A * | 5/1986 | Bloom et al. | 400/583 |
| 5,564,845 | A * | 10/1996 | Yamaguchi et al. | 400/583 |
| 5,980,139 | A * | 11/1999 | Chapman et al. | 400/583 |
| 7,811,015 | B2 * | 10/2010 | Yanagi et al. | 400/76 |
| 2008/0143807 | A1 * | 6/2008 | Bartley et al. | 347/104 |
| 2010/0330262 | A1 * | 12/2010 | Takeuchi et al. | 427/8 |
| 2011/0255911 | A1 * | 10/2011 | Eun et al. | 400/76 |
| 2013/0028647 | A1 * | 1/2013 | Okada et al. | 400/583 |

FOREIGN PATENT DOCUMENTS

JP 2009-269713 A 11/2009

* cited by examiner

*Primary Examiner* — Jill Culler

(74) *Attorney, Agent, or Firm* — Canon USA Inc. IP Division

(57) ABSTRACT

A conveyance apparatus includes a feeding unit, on which a roll sheet is settable, configured to feed the roll sheet, a conveyance roller configured to convey a sheet fed from the feeding unit, a first detection unit configured to detect a conveyance distance of the sheet conveyed by the conveyance roller, a second detection unit configured to detect a conveyance distance of the sheet drawn out from the roll sheet set on the feeding unit, a driving unit configured to synchronously drive the feeding unit when the sheet is conveyed by the conveyance roller, and a determination unit configured to determine a state of an end portion of the roll sheet based on detection results by the first detection unit and the second detection unit.

14 Claims, 12 Drawing Sheets

CONVEYANCE APPARATUS AND RECORDING APPARATUS

BACKGROUND OF THE INVENTION

1. Field of the Invention

The present invention relates to a conveyance apparatus for conveying a sheet, which is drawn out from a roll sheet, by a conveyance roller.

2. Description of the Related Art

Some types of image forming apparatuses can use A2 or larger size continuous sheets. In such image forming apparatuses, a roll sheet in which the continuous sheet is wound on a paper tube is commonly used.

As a state of an end portion of the roll sheet, one type of roll sheet in which the end portion thereof is not fixed to the paper tube is provided. In this type of roll sheet, the paper tube alone can make idle rotation. The state in which the paper tube alone can make idle rotation is referred to as a "separation state". Further, there is another type of roll sheet in which an end portion thereof is fixed to the paper tube with a tape. In this type of roll sheet, there is a case where the roll sheet cannot be fed from a feeding unit. The state in which the end portion of the roll sheet is not separable from the paper tube is referred to as a "non-separable state". In the non-separable state, the roll sheet is pulled by the feeding unit and a conveyance unit that is disposed on the downstream side of the feeding unit. If a printing operation is continued in this situation, there is a problem in which the printing operation is repeatedly executed on the same place of the roll sheet.

Japanese Patent Application Laid-Open No. 2009-269713 discusses a configuration for determining whether the roll sheet is in a non-conveyable state in which the end portion thereof is fixed to a roll sheet shaft, by changing a driving condition of a roll sheet driving unit when a detection unit detects that the roll sheet is close to the end portion thereof.

In Japanese Patent Application Laid-Open No. 2009-269713, when it is detected that the roll sheet is close to the end portion thereof, a motor for driving the roll sheet shaft is driven in a rewind direction. In the case where a moving amount of the roll sheet is not a proper value, the roll sheet is determined to be in a non-separable state. Since the configuration discussed in Japanese Patent Application Laid-Open No. 2009-269713 cannot make the determination without driving the motor in the rewind direction, the printing operation has to be suspended, and thus, it is problematic in that productivity of the printing apparatus is lowered.

SUMMARY OF THE INVENTION

The present invention is directed to a conveyance apparatus capable of determining an abnormal state of an end portion of a roll sheet without lowering the throughput of the apparatus.

According to an aspect of the present invention, a conveyance apparatus includes a feeding unit, on which a roll sheet is settable, configured to feed the roll sheet, a conveyance roller configured to convey a sheet fed from the feeding unit, a first detection unit configured to detect a conveyance distance of the sheet conveyed by the conveyance roller, a second detection unit configured to detect a conveyance distance of the sheet drawn out from the roll sheet set on the feeding unit, a driving unit configured to synchronously drive the feeding unit when the sheet is conveyed by the conveyance roller, and a determination unit configured to determine a state of an end portion of the roll sheet based on detection results by the first detection unit and the second detection unit.

Further features of the present invention will become apparent from the following description of exemplary embodiments with reference to the attached drawings.

DESCRIPTION OF THE EMBODIMENTS

Figure 1:
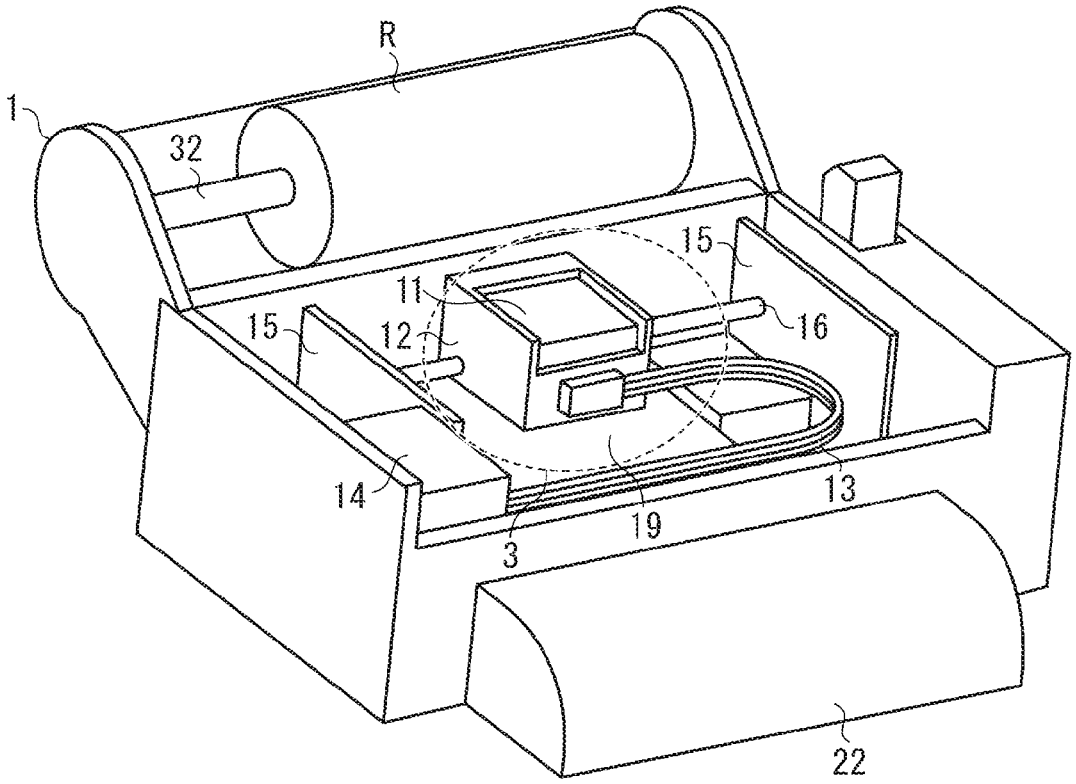
FIG. 1 is a perspective view illustrating a recording apparatus according to an exemplary embodiment of the present invention.
Figure 2:
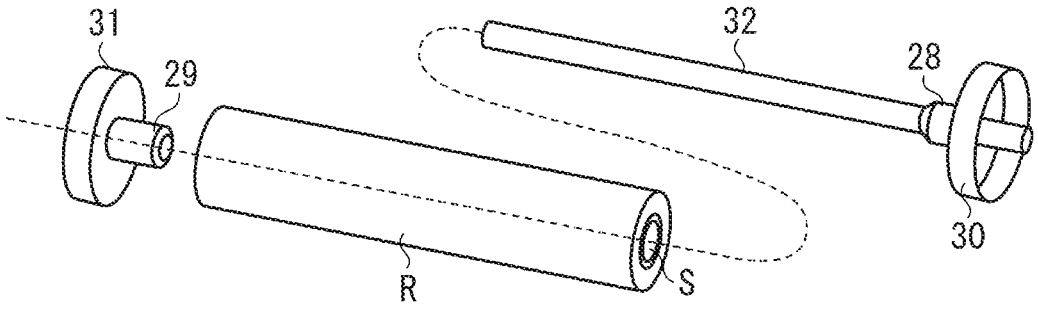
FIG. 2 is a diagram illustrating an installation configuration of a roll sheet.
Figure 3:
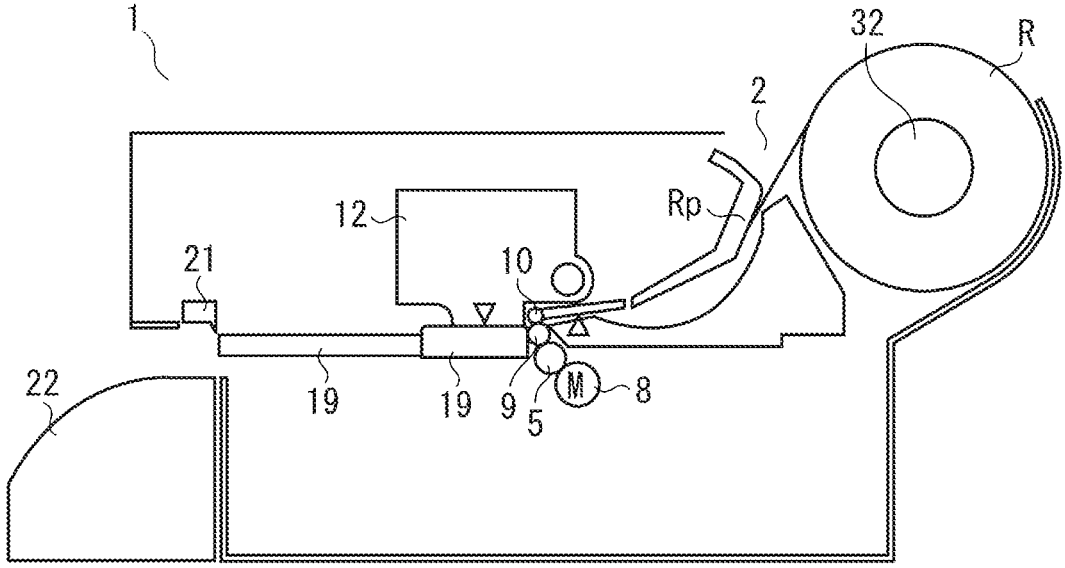
FIG. 3 is a cross-sectional view of the recording apparatus according to the exemplary embodiment of the present invention.

An exemplary embodiment of the present invention will be described below in detail with reference to the drawings. FIG. 1 is a perspective view illustrating a recording apparatus according to the exemplary embodiment of the present invention. FIG. 2 is a diagram illustrating an installation configuration of a roll sheet. FIG. 3 is a cross-sectional view of the recording apparatus according to the exemplary embodiment of the present invention.

A setting operation of a recording medium in the present exemplary embodiment will be described. A roll sheet R as a continuous sheet wound in a roll shape is used as the recording medium of the present exemplary embodiment. As illustrated in FIG. 2, a spool shaft 32 penetrates through a paper tube S of the roll sheet R. A reference side loading portion 28 of a reference side roll sheet holder 30 provided on one end of the spool shaft 32 is tightly fit to an inner wall of the paper tube S by an elastic force in a radial direction, so that the spool shaft 32 is fixed and held therein. The reference side roll sheet holder 30 is fixed to the spool shaft 32 in a non-rotatable manner. Further, the spool shaft 32 penetrates through a non-reference side roll sheet holder 31 provided on the opposite side of the reference side roll sheet holder 30 to hold the roll sheet R therebetween, so that the spool shaft 32 is set to the paper tube S. In addition, a non-reference side loading portion 29 is also provided on the non-reference side roll sheet holder 31. The non-reference side loading portion 29 is also fixed and held with respect to the paper tube S with the elastic force in the radial direction. Then, as illustrated in FIG. 1, both ends of the spool shaft 32 are supported by a printer apparatus main body 1 in a rotatable manner, so that the roll sheet R is also supported in a rotatable manner. In the following description, a leading end portion of the sheet drawn out from the roll sheet R is referred to as a leading end Rp.

Next, a feeding operation will be described. The leading end Rp of the roll sheet R that is set to a position illustrated in FIG. 3 is introduced to a conveyance path through a conveyance inlet 2 by a user's hand. Then, when the user rotates the roll sheet R in a counter-clockwise (CCW) direction, the leading end Rp of the roll sheet R passes through the conveyance path to be conveyed downstream. When a sheet sensor 6 provided on the conveyance path detects that the leading end Rp of the roll sheet R has passed therethrough, a conveyance motor 8 is driven to rotate the conveyance roller 9 in the CCW direction. The leading end Rp of the roll sheet R that is further conveyed downstream by the user's hand is pinched by a conveyance roller pair configured of the conveyance roller 9 and a pinch roller 10, and conveyed onto a platen 19. In the subsequent operations, because the roll sheet R is conveyed by the conveyance roller pair 9 and 10, at this point, the user releases his/her hand from the roll sheet R.

In FIG. 1, the recording apparatus main body 1 includes an image recording unit 3. The image recording unit 3 includes a recording head 11, a carriage 12 which moves while carrying the recording head 11, and the platen 19 which supports the roll sheet R at a position opposite to the recording head 11. The recording head 11 includes a plurality of nozzle rows configured of a plurality of nozzles arranged in a conveyance direction of the roll sheet R. To the nozzle of each color provided in the recording head 11, an ink tank 14 of each color supplies ink via a supply tube 13. The carriage 12 is guided by a guide shaft 16 both end portions of which are fixed to frames 15 of the recording apparatus main body 1, and a guide rail (not illustrated) to move in a direction orthogonal to the conveyance direction of the roll sheet R. Then, ink is discharged to the roll sheet R from the recording head 11 while the carriage 12 moves reciprocally, and an image is formed on the roll sheet R. An operation for recording one-line worth of the image by causing the carriage 12 to move in the forward direction or the backward direction, and an operation for conveying the roll sheet R by the conveyance roller pair 9 and 10 are executed repeatedly, so that the image is formed on the roll sheet R. The roll sheet R on which the image is formed is discharged to a discharge tray 22. Then, when the image forming operation is completed, the roll sheet R is cut by a cutter 21.

Figure 4:
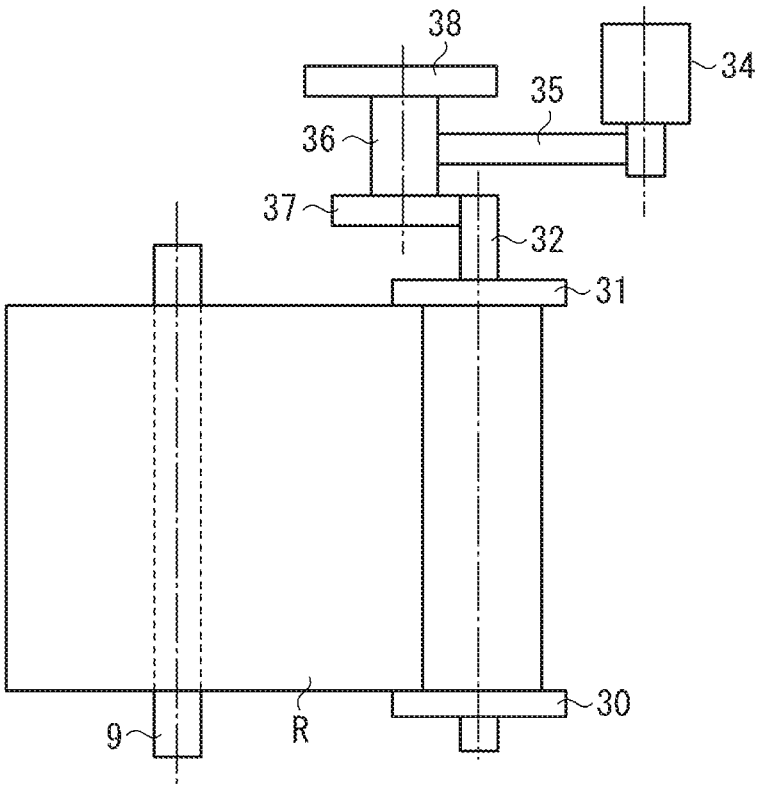
FIG. 4 is a diagram illustrating a configuration for driving the roll sheet.

FIG. 4 is a diagram illustrating a configuration for driving the roll sheet R at a feeding unit. The feeding unit includes a feeding motor 34 for applying a driving force to the roll sheet R, gear trains 35, 36, and 37 for transmitting the driving force of the feeding motor 34 to the roll sheet R, and a feeding encoder 38.

Figure 5:
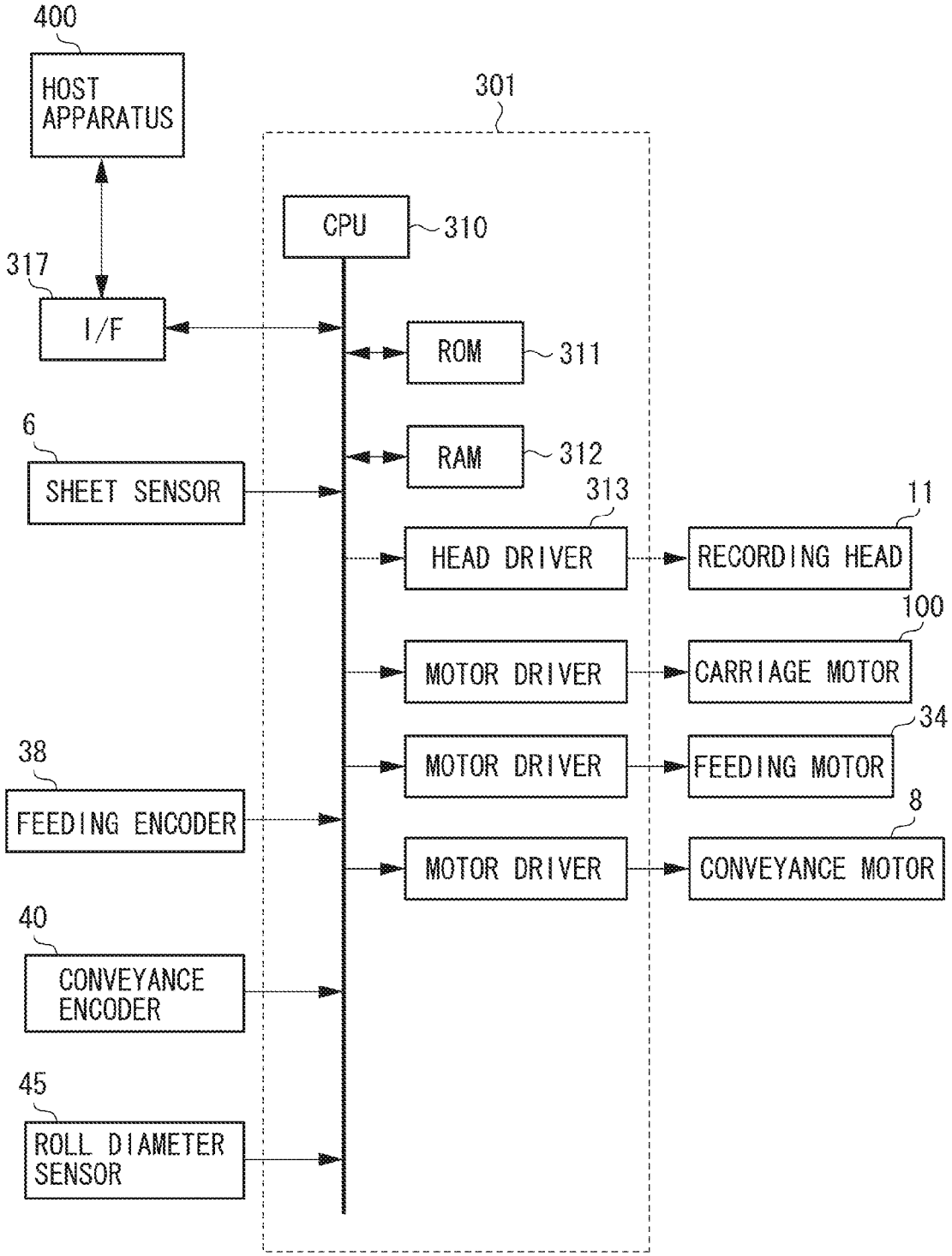
FIG. 5 is a block diagram of the recording apparatus.

FIG. 5 is a block diagram of the recording apparatus. A control unit 301 includes a central processing unit (CPU) 310 which performs control processing, a read-only memory (ROM) 311 in which a control program and various kinds of information and constant numbers are stored, and a random access memory (RAM) 312 which temporarily stores information and serves as a work area for information processing. The control unit 311 further includes a head driver 313 and various motor drivers.

A carriage motor 100 moves the carriage 12. A conveyance encoder 40 detects a rotation amount of the conveyance roller 9. The conveyance encoder 40 includes a first code wheel disposed on a rotational shaft of the conveyance roller 9, or a rotational shaft of a gear or a motor for driving the conveyance roller 9. Marks or slits are formed on the first code wheel at a predetermined interval along the outer circumference thereof. The conveyance encoder 40 also includes a sensor as a first count unit for detecting the mark or the slit on the first code wheel.

A feeding encoder 38 detects a rotation amount of the spool shaft 32. The feeding encoder 38 includes a second code wheel disposed on the spool shaft 32 or a rotational shaft of a gear or a motor for driving the spool shaft 32. Marks or slits are formed on the second code wheel at a predetermined interval along the outer circumference thereof. The feeding encoder 38 also includes a sensor as a second count unit for detecting the mark or the slit on the second code wheel.

A roll diameter sensor 45 measures a diameter of the roll sheet R set on the feeding unit. The roll diameter sensor 45 measures a swing angle of a swing lever which contacts the outer circumference of the roll sheet R, and calculates the diameter from the swing angle.

A host apparatus 400 such as a computer provides the control unit 301 with a print job or information relating to a sheet via an interface (I/F) 317.

Figure 6:
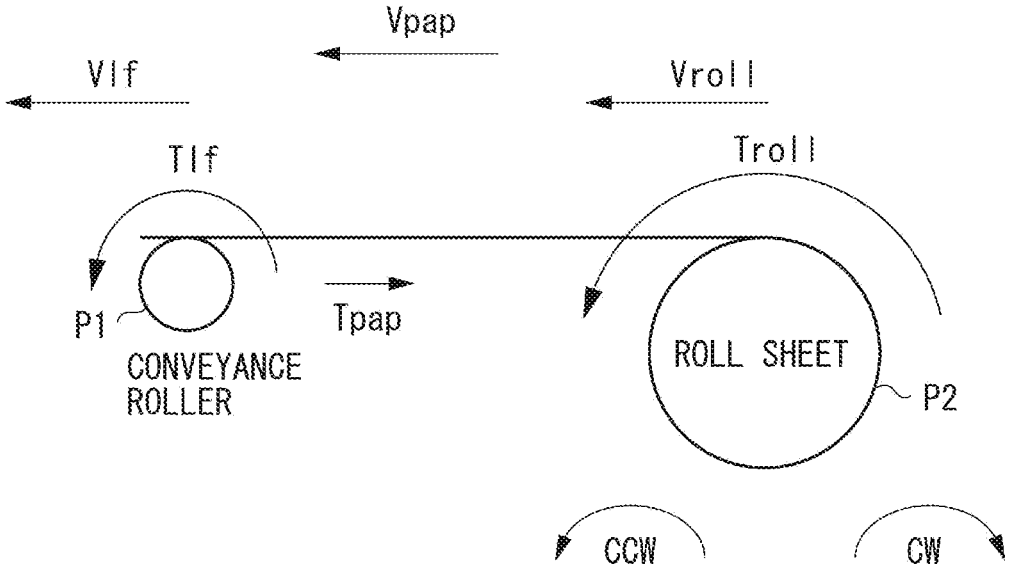
FIG. 6 is an explanatory diagram illustrating the conveyance speed of a conveyance roller, the moving speed of the roll sheet set on a feeding unit, and the torques of the conveyance roller and the roll sheet.

FIG. 6 is a diagram illustrating conveyance speed of the conveyance roller 9, moving speed of the roll sheet R set on the feeding unit, and torques of the conveyance roller 9 and the roll sheet R. The driving torque of the conveyance roller 9 is a torque Tlf, the driving torque of the roll sheet R set on the feeding unit is a torque Troll, and tension applied to a sheet placed between the conveyance roller 9 and the feeding unit is a tension Tpap. Further, the conveyance speed of the conveyance roller 9 is a speed Vlf, the conveyance speed of the roll sheet R set on the feeding unit is a speed Vroll, and the conveyance speed of the sheet fed from the feeding unit is a speed Vpap. Rotational directions of the torque Tlf and the torque Troll are directions of arrows indicated as "CCW" and "CW" in FIG. 6. Directions of arrows for the tension Tpap, the speed Vlf, the speed Vroll, and the speed Vpap in FIG. 6 are positive values. Relationship between the conveyance speed and the torque illustrated in FIG. 7 through FIG. 10 will be described based on the directions illustrated in FIG. 6.

Figure 7:
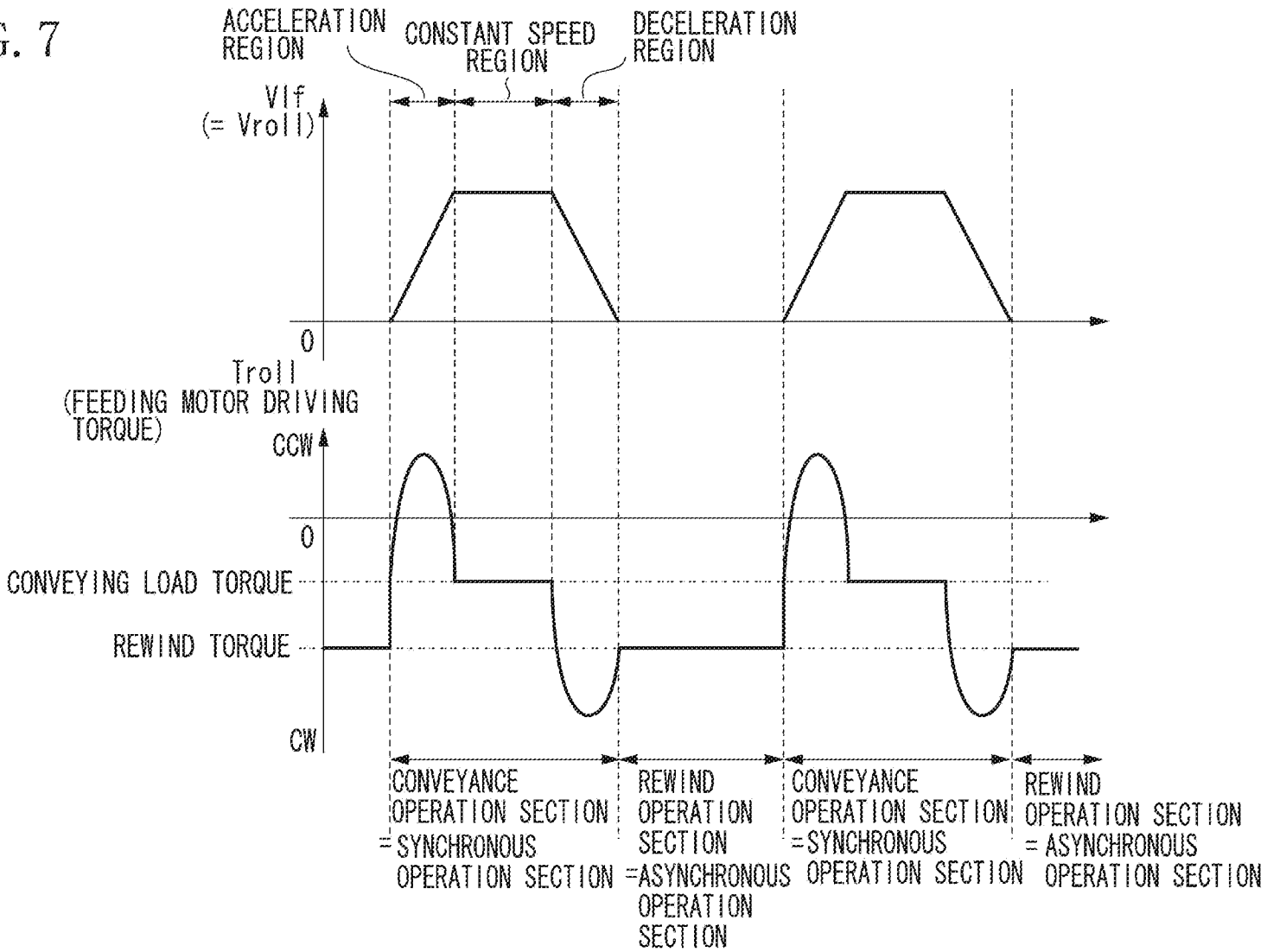
FIG. 7 is a diagram illustrating a relationship between the conveyance speed of the conveyance roller and the driving torque of a feeding motor.

FIG. 7 is a diagram illustrating a relationship between the conveyance speed Vlf of the conveyance roller 9 and the driving torque Troll of the feeding motor 34. In FIG. 7, in a conveyance operation section where the conveyance roller 9 rotates, the driving torque of the feeding motor 34 (=torque Troll) is controlled so that the tension Tpap applied to the sheet between the conveyance roller 9 and the feeding unit becomes a constant value. The above conveyance operation section is referred to as a synchronous operation section. A section in which the conveyance roller 9 is stopped while the feeding motor 34 rewinds the roll sheet R is a section, in which the feeding motor 34 independently executes a rewind operation. Therefore, the section is referred to as an asynchronous operation section. In the synchronous operation section, basically, the conveyance speed Vlf of the conveyance roller 9 and the conveyance speed Vroll of the roll sheet R conform to each other. In the case where a loosening occurs on the sheet due to various kinds of disturbance conditions, the loosening of the sheet is cancelled by the rewind operation performed in the asynchronous operation section.

The synchronous operation section will be described in detail. The conveyance speed Vlf of the conveyance roller 9 is expressed by a driving waveform having an acceleration region, a constant speed region, and a deceleration region.

In the constant speed region, because there is no effect of an inertia component of the roll sheet R, the torque is set, as the driving torque Troll for the roll sheet R, so that a value of the tension applied to the sheet is equivalent to the tension Tpap.

Basically, the driving torque Troll of the roll sheet R is a value as a load against the conveyance direction of the conveyance roller 9. Thus, the torque in the CW direction (clockwise direction), which is the opposite direction of the torque Tlf, is set to the driving torque Troll. However, in the case where the tension Tpap that is to be generated is smaller than the tension applied to the sheet by the original mechanical load of a roll driving unit, the driving torque of the roll sheet R may be set in the CCW direction.

Next, the acceleration region will be described. To accelerate the conveyance speed of the sheet, it is necessary to apply the torque opposed to the inertia of the roll sheet R set on the feeding unit to increase the rotating speed of the roll sheet R. If the torque having the same value as in the constant speed region is simply applied thereto, the tension Tpap is increased due to a load corresponding to the inertia of the roll sheet R. Therefore, the torque opposed to the inertia of the roll sheet R to increase the rotating speed of the roll sheet R is added to the driving torque set in the constant speed region, so that the tension Tpap is suppressed from being increased.

Next, the deceleration region will be described. In the deceleration region, the torque opposed to the inertia of the roll sheet R to reduce the rotating speed of the roll sheet R has to be applied to the roll sheet R. If the torque having the same value as in the constant speed region is applied to the roll sheet R, reduction of the rotating speed of the roll sheet R is delayed due to the inertia of the roll sheet R, so that an excess loosening occurs on the sheet. Therefore, the torque opposed to the inertia of the roll sheet R to reduce the rotating speed of the roll sheet R is added to the driving torque of the roll sheet R set in the constant speed region, so that the excess loosening can be suppressed from occurring on the sheet. Because the deceleration has a negative value, the direction of the torque for reducing the rotating speed of the roll sheet R is the CW direction.

By applying the above-described torque Troll to the roll sheet R by the feeding motor 34, a load variation caused by the roll sheet R may be suppressed, and the synchronous conveyance may be performed while making the tension Tpap constant.

The asynchronous operation section will be described. In the asynchronous operation section, because an operation for rewinding the roll sheet R is independently executed, the driving torque of the feeding motor 34 is applied in the CW direction. In the case where the torque value of the driving torque is exceedingly large, this may cause disturbance of a stop position of the roll sheet R. Therefore, the rewind operation is executed while regulating the torque value with a rewind torque value set within a range, which does not disturb the conveyance accuracy.

Next, a configuration for determining a state in which the end portion of the roll sheet R is separated from the paper tube and the feeding unit (separation state), and a state in which the end portion of the roll sheet R is fixed to the paper tube and not separable from the feeding unit (non-separable state) will be described. In the separation state, the paper tube is driven by the feeding motor 34 to make idle rotation. In the non-separable state, because the end portion of the roll sheet R is not separable from the paper tube, even if the conveyance motor 8 drives the conveyance roller 9, the roll sheet R cannot be conveyed downstream.

Determination of the separation state and the non-separable state is executed by comparing the conveyance distance conveyed by the conveyance roller 9 with the conveyance distance of the roll sheet R.

The conveyance distance conveyed by the conveyance roller 9 is substantially equal to a distance L1 in which an outer circumferential surface of the conveyance roller 9 passes through a nip between the conveyance roller 9 and the pinch roller 10. The distance L1 in which the outer circumferential surface of the conveyance roller 9 passes through a nip position P1 (see FIG. 6) before a predetermined timing after the rotation is started from a reference phase can be acquired from a difference between a count value of the conveyance encoder 40 at the predetermined timing and a reference count value of the conveyance encoder 40 at the reference phase. The passage distance L1 of the outer circumferential surface can be acquired from the rotation angle θ1 (radian) and a radius r1 of the conveyance roller 9 after acquiring the rotation angle θ1 of the conveyance roller 9 from the difference between the count values of the conveyance encoder 40.

$$L1=\theta 1\times r1$$

The passage distance L1 of the outer circumferential surface of the conveyance roller 9 is calculated by the conveyance encoder 40 and the control unit 301. The conveyance encoder 40 and the control unit 301 constitute a first detection unit.

A conveyance distance L2 of the sheet drawn out from the roll sheet R set on the feeding unit before a predetermined timing after the rotation is started from a reference phase is substantially equal to a distance of the outer circumferential surface of the roll sheet R passing through a position P2 (see FIG. 6) where the sheet is separated from the roll sheet R. The passage distance L2 of the outer circumferential surface of the roll sheet R from the reference phase to the predetermined timing can be acquired from a difference between a count value of the feeding encoder 38 at the predetermined timing and a reference count value of the feeding encoder 38 at the reference phase. A rotation angle θ2 (radian) of the roll sheet R is acquired from the difference between the count values, and a radius r2 of the roll sheet R at the predetermined timing is acquired by the roll diameter sensor 45. The passage distance L2 of the outer circumferential surface of the roll sheet R can be acquired by the following formula:

$$L2=\theta 2\times r2$$

The passage distance L2 of the outer circumferential surface of the roll sheet R is calculated by the feeding encoder 38, the roll diameter sensor 45, and the control unit 301. The feeding encoder 38, the roll diameter sensor 45, and the control unit 301 constitute a second detection unit. In addition, because the diameter of the roll sheet R can also be calculated from a consumption amount and a thickness of the sheet, the second detection unit without having the roll diameter sensor 45 may be employed as well.

Figure 8:
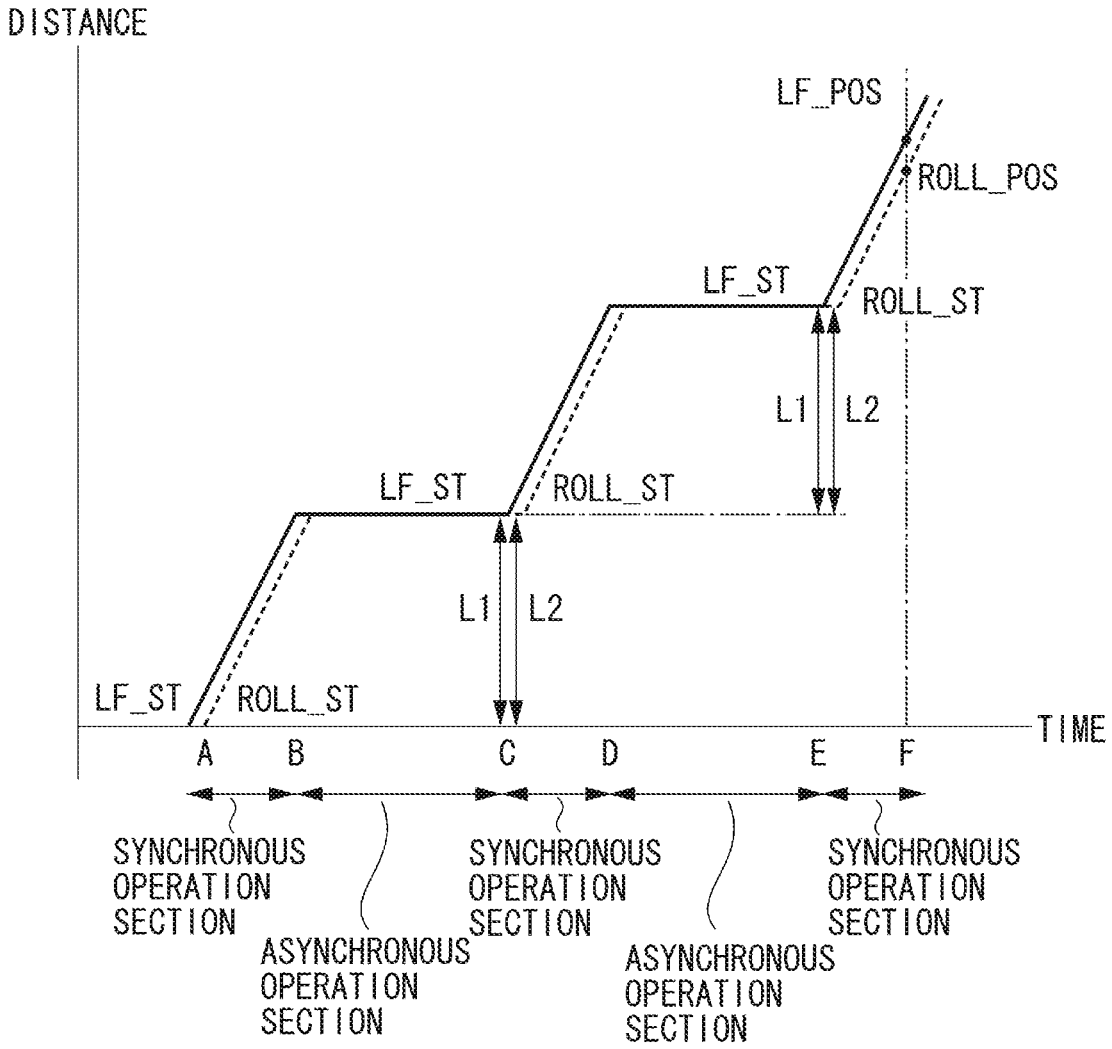
FIG. 8 is a diagram illustrating a relationship between a conveyance distance conveyed by the conveyance roller and a conveyance distance of the sheet drawn out from the roll sheet set on the feeding unit.

FIG. 8 is a diagram illustrating a relationship between the conveyance distance L1 conveyed by the conveyance roller 9 and the conveyance distance L2 of the sheet drawn out from the roll sheet R set on the feeding unit. In FIG. 8, a horizontal axis indicates a time axis, and a vertical axis indicates the conveyance distance L1 conveyed by the conveyance roller 9 and the conveyance distance L2 of the sheet drawn out from the roll sheet R. In FIG. 8, a solid line indicates the conveyance distance L1 conveyed by the conveyance roller 9, whereas a dashed line indicates the conveyance distance L2 of the sheet drawn out from the roll sheet R. Time A to time B, and time C to time D are the synchronous operation sections, and time B to time C and time D to time E are the asynchronous operation sections. In the synchronous operation section, both the conveyance distance L1 conveyed by the conveyance roller 9 and the conveyance distance L2 of the sheet drawn out from the roll sheet R are increased. In the asynchronous section, torque in the rewind direction is applied to the roll sheet R set on the feeding unit. At this time, the conveyance roller 9 is not driven but stopped. Further, because the sheet drawn out from the roll sheet R is kept nipped by the conveyance roller pair 9 and 10, the conveyance distance L1 conveyed by the conveyance roller 9 and the conveyance distance L2 of the sheet drawn out from the roll sheet R does not change.

Basically, because the conveyance roller 9 and the roll sheet R set on the feeding unit move in synchronization with each other, the solid line and the dashed line have approximately the same loci. In the case where the loosening occurs on the sheet in the synchronous operation section, the conveyance distance L2 of the sheet drawn out from the roll sheet R exceeds the conveyance distance L2 conveyed by the conveyance roller 9. However, in the next asynchronous operation section, the roll sheet R set on the feeding unit is rotated in the rewind direction of the sheet. Thus, the conveyance distance L1 conveyed by the conveyance roller 9 and the conveyance distance L2 of the sheet drawn out from the roll sheet R conform to each other.

When the state of the end portion of the roll sheet R is determined, at first, a phase of the conveyance roller 9 at a line LF_ST and a phase of the roll sheet R at a line ROLL_ST, which are parallel to the time axis and indicate the stopped state, are set to be the reference phases. Thereafter, the count value of the encoder at the reference phase is updated at each conveyance operation. In FIG. 8, the first reference phase is a phase at time A. After that, a phase at time C, and a phase at time E will be the subsequent reference phases.

At a point LF_POS on the solid line at time F in FIG. 8, the conveyance distance L1 conveyed by the conveyance roller 9 for determining the state of end portion is a distance from the closest line LF_ST to the point LF_POS. At a point ROLL_POS on the dashed line at time F, the conveyance distance L2 of the sheet drawn out from the roll sheet R set on the feeding unit for determining the state of end portion is a distance from the closest line ROLL_ST to the point ROLL_POS.

By updating the line LF_ST and the line ROLL_ST at each conveyance operation, an effect of a measurement error in the diameter of the roll sheet R can be minimized. In the case where the line LF_ST and the line ROLL_ST as reference phases at time A and time C are updated, and a difference between the conveyance distance L1 conveyed by the conveyance roller 9 and the conveyance distance L2 of the sheet drawn out from the roll sheet R becomes greater than a predetermined threshold value in the period from time A to time B and the period from time C to time D, it is determined that the roll sheet R is close to the end portion thereof.

In FIG. 8, an absolute value of the difference between the conveyance distance L1 conveyed by the conveyance roller 9 and the conveyance distance L2 of the sheet drawn out from the roll sheet R is constantly smaller than a predetermined threshold value T ($|L1-L2|<T$), and the conveyance distances L1 and L2 have the same values in the asynchronous operation section. Therefore, it is not determined that the roll sheet R is close to the end portion thereof.

Figure 9:
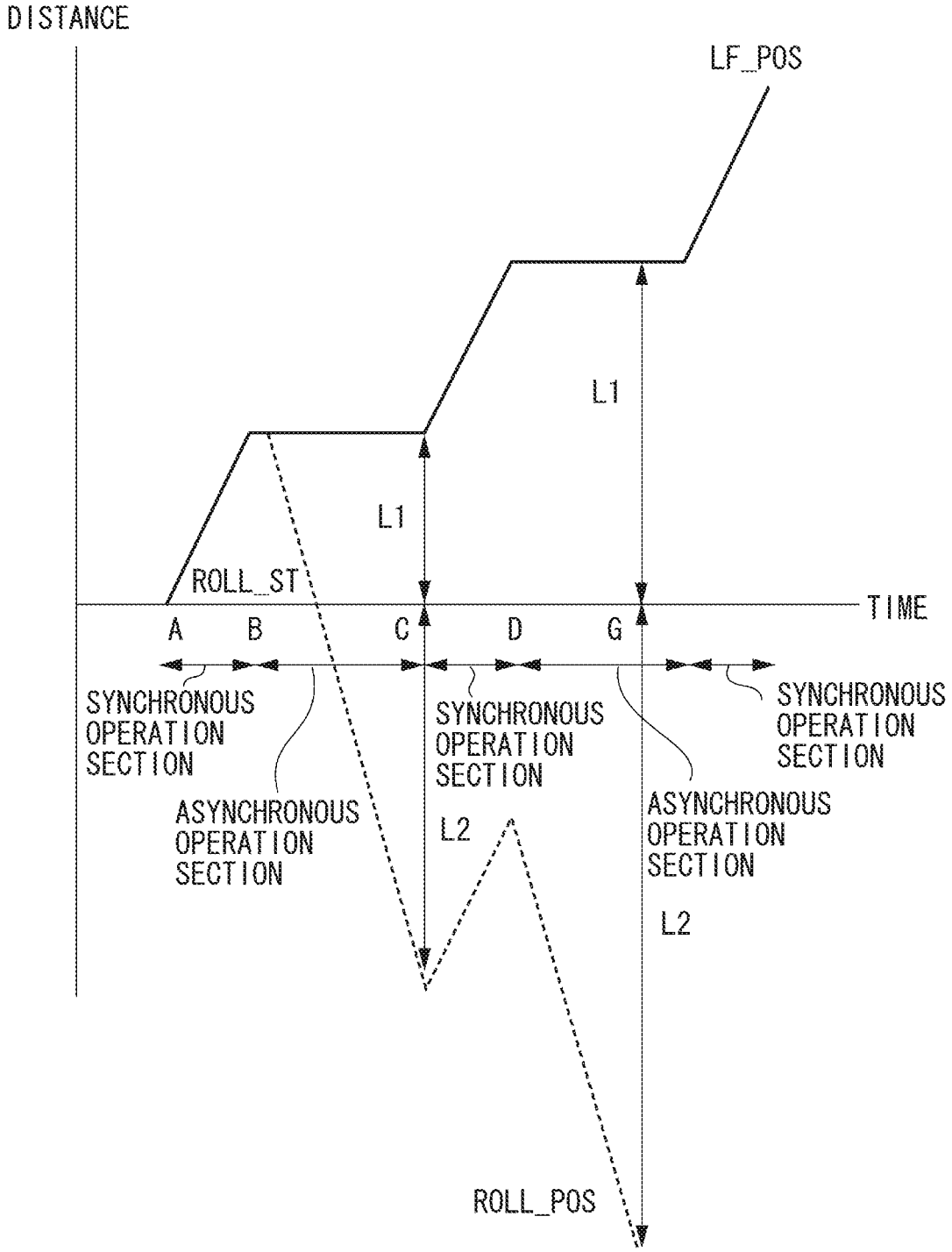
FIG. 9 is a diagram illustrating a relationship between the conveyance distance conveyed by the conveyance roller and the conveyance distance of the sheet drawn out from the roll sheet set on the feeding unit.

FIG. 9 is a diagram illustrating a relationship between the conveyance distance L1 conveyed by the conveyance roller 9 and the conveyance distance L2 of the sheet drawn out from the roll sheet R set on the feeding unit in the separation state where the end portion of the roll sheet R is separated from the paper tube.

A state in which the paper tube alone can freely move while the end portion of the roll sheet R is separated from the paper tube in the synchronous operation section from time A to time B will be described. In the asynchronous operation section from time B to time C, although the rewind operation for rewinding the sheet is performed by rotating the spool shaft 32 in the clockwise direction, only the paper tube makes idle rotation because the rear end of the roll sheet R is separated from the paper tube.

In the period from time B to time C, the conveyance distance L1 conveyed by the conveyance roller 9 does not change because the conveyance roller 9 is stopped. The conveyance distance L2 of the sheet drawn out from the roll sheet R set on the feeding unit is decreased because the feeding encoder 38 is rotated although the roll sheet R is not actually rewound. The conveyance distance L2 of the sheet drawn out from the roll sheet R set on the feeding unit changes significantly on the negative side. Therefore, the absolute value of the difference between the conveyance distance L1 conveyed by the conveyance roller 9 and the conveyance distance L2 of the sheet drawn out from the roll sheet R exhibits an increasing tendency. However, because the absolute value does not exceed the threshold value at the point of time C, next conveyance operation is executed from time C.

In the period from time C to time D, the conveyance roller 9 and the spool shaft 32 rotate in synchronization with each other. The absolute value of the difference between the conveyance distance L1 conveyed by the conveyance roller 9 and the conveyance distance L2 of the sheet drawn out from the roll sheet R calculated by the feeding encoder 38 maintains the value at time C.

If the operation in the period from time B to time C is performed normally, the conveyance encoder count number and the feeding encoder count number are updated before the conveyance operation is started at time C. However, in the case where the reverse rotation operation of the spool shaft 32 is not stopped by time C, it is determined that the rewind operation has not been completed, and, thus, the encoder count numbers are not updated. With this operation, the conveyance distance L1 conveyed by the conveyance roller 9 and the conveyance distance L2 of the sheet drawn out from the roll sheet R are calculated in a cumulative manner. With this configuration, a state of the end portion of the roll sheet R can be properly detected even in the case where the subtle conveyance operation is repeatedly executed.

In the asynchronous operation section from time D, although the rewind operation for rewinding the sheet is executed by rotating the spool shaft 32 in the clockwise direction, the paper tube makes idle rotation. The spool shaft 32 alternately repeats the rotation in the sheet feeding direction and the rotation in the sheet rewinding direction. The count values of the feeding encoder 38 are cumulatively calculated by making the count value in the feeding direction a positive value whereas the count value in the rewinding direction a negative value. Then, at time G, the absolute value of the difference between the conveyance distance L1 conveyed by the conveyance roller 9 and the conveyance distance L2 of the sheet drawn out from the roll sheet R set on the feeding unit exceeds the threshold value T, so that the absolute value of the difference becomes $|L1-L2|>T$. The absolute value $|L1|$ of the conveyance distance L1 conveyed by the conveyance roller 9 and the absolute value $|L2|$ of the conveyance distance L2 of the sheet drawn out from the roll sheet R at this point of time are compared to each other. As illustrated in FIG. 9, if the absolute value |L1| is smaller than the absolute value |L2| (|L2|>|L1|), it is determined that the end portion of the roll sheet R is separated from the paper tube and the paper tube makes idle rotation. In addition, because the roll sheet R is rewound in the asynchronous operation section, the respective conveyance distances are less likely to be L1<L2. Therefore, when the respective values are L1−L2>T and also |L2|>|L1|, the state may be determined that the end portion of the roll sheet R is separated from the paper tube and the paper tube makes idle rotation.

Alternatively, because the paper tube makes idle rotation, the conveyance distance L2 has a negative value at time G in FIG. 9. Accordingly, when the respective values are |L1−L2|>T or L1−L2>T, and also L2<0, the state may simply be determined that the end portion of the roll sheet R is separated from the paper tube.

Alternatively, when the respective values are |L1−L2|>T or L1−L2>T, and also L1>L2, the state may be determined that the end portion of the roll sheet R is separated from the paper tube.

Furthermore, in the case where a rewind amount of the roll sheet R in the asynchronous operation section is small, respective absolute values of a moving amount in the positive direction and a moving amount in the negative direction are cumulatively calculated and compared to the conveyance distance L1. In other words, if the moving amount in the positive direction in the synchronous operation section is "L2plus" whereas the moving amount in the negative direction in the asynchronous operation section is "L2minus", the state may be determined that the end portion of the roll sheet R is separated from the paper tube when the respective values are L1−L2>T, and also |L2plus|+|L2minus|>|L1|.

In the case where the roll sheet R is determined to be in the separation state during the printing operation, the printing operation is continued as much as possible up to a point close to the end portion of the roll sheet R, so that the printing can be executed in an economical manner for the user. In this case, a sensor disposed in the vicinity of the conveyance roller 9 is employed, so that the printing is stopped when the sensor detects that the end portion of the roll sheet R reaches the vicinity of the conveyance roller 9. At this time, it is desirable to correct the conveyance amount of the conveyance roller 9 because back tension generated on the roll sheet R is different from that in the normal time.

Alternatively, in the case where the remaining amount of the roll sheet R at the time the roll sheet R is determined to be in the separation state is smaller than the image data that is being printed, the apparatus may be controlled to prompt the user to stop printing or reset the roll sheet R.

Figure 10:
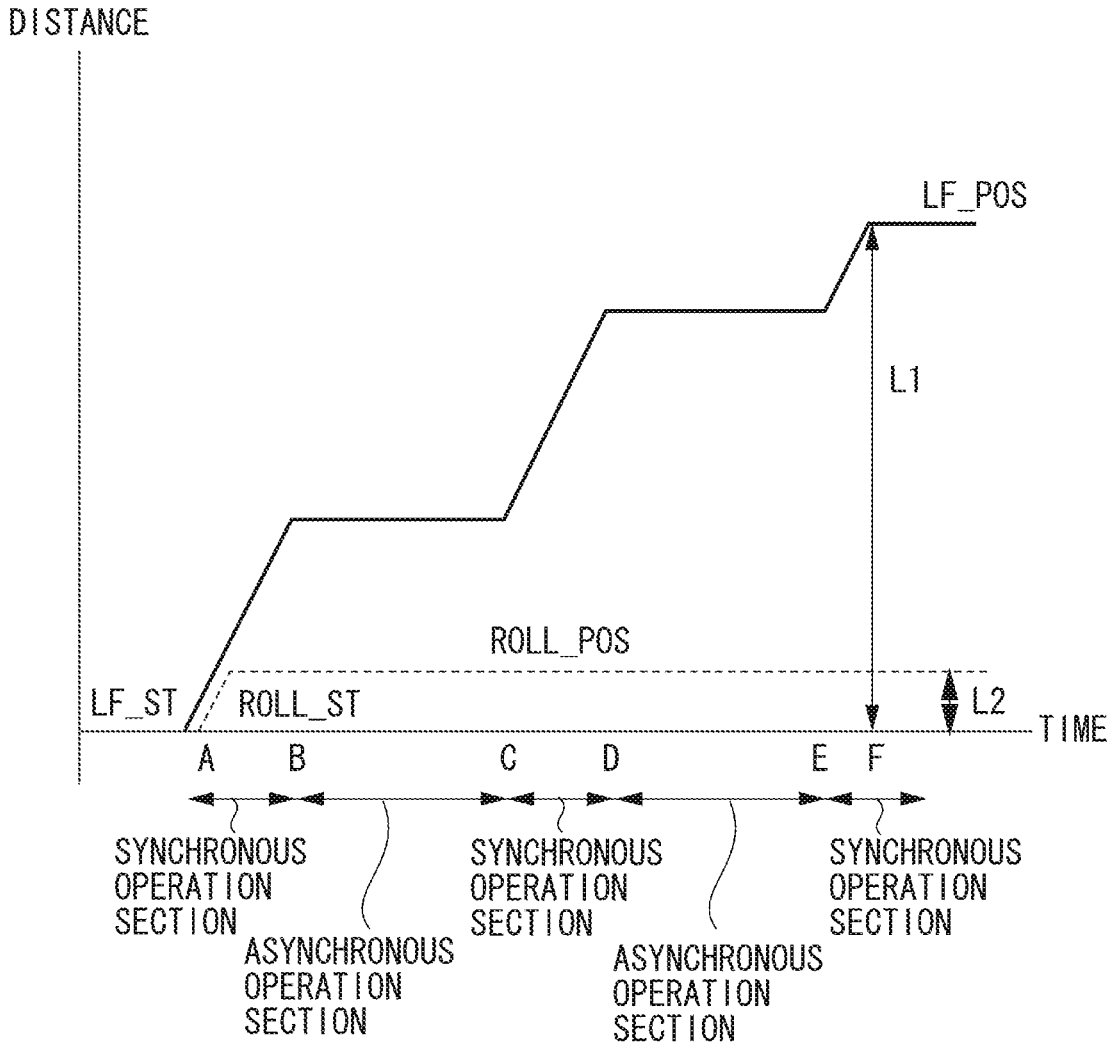
FIG. 10 is a diagram illustrating a relationship between the conveyance distance conveyed by the conveyance roller and the conveyance distance of the sheet drawn out from the roll sheet set on the feeding unit.

FIG. 10 is a diagram illustrating a relationship between the conveyance distance L1 conveyed by the conveyance roller 9 and the conveyance distance L2 of the sheet drawn out from the roll sheet R set on the feeding unit when the roll sheet R is in the non-separable state where the end portion of the roll sheet R is not separable from the paper tube.

The case in which the end portion of the roll sheet R is fixed with the tape and not separable from the paper tube when the roll sheet R comes to the end portion thereof in the synchronous operation section from time A to time B will be described. After the roll sheet R comes to the end portion, in both the synchronous operation section and the asynchronous operation section, the sheet is pulled by the conveyance roller 9 and the roll sheet R (spool shaft 32). In this case, the conveyance roller 9 is assumed to have a sufficient driving force, and, thus, the conveyance roller 9 can rotate while sliding against the sheet that cannot move. Accordingly, the rotation amount (moving amount of the outer circumferential surface) of the conveyance roller 9 does not correspond to the actual conveyance distance of the sheet. Therefore, the conveyance distance L1 of the conveyance roller 9 calculated by the conveyance encoder 40 is increased at each conveyance operation. On the contrary, because the spool shaft 32 cannot rotate, the conveyance distance L2 of the sheet drawn out from the roll sheet R remains unchanged.

In the conveyance operation period from time A to time B, the roll sheet R falls into a state where the end portion thereof cannot move. The roll sheet R becomes in a stopped state, so that the conveyance distance L2 of the sheet drawn out from the roll sheet R has a constant value. On the contrary, the conveyance distance L1 conveyed by the conveyance roller 9 calculated by the conveyance encoder 40 is increased at each conveyance operation. Therefore, the absolute value of the difference between the conveyance distance L1 conveyed by the conveyance roller 9 and the conveyance distance L2 of the sheet drawn out from the roll sheet R is increased with time until time B. However, because the absolute value of the difference does not exceed the threshold value at time B, next conveyance operation is executed from time C. In the period from time B to time C, the conveyance distance L1 conveyed by the conveyance roller 9 and the conveyance distance L2 of the sheet drawn out from the roll sheet R remain unchanged.

In the period from time C to time D, the paper tube does not rotate although the conveyance roller 9 rotates. Therefore, the absolute value of the difference between the conveyance distance L1 conveyed by the conveyance roller 9 and the conveyance distance L2 of the sheet drawn out from the roll sheet R calculated by the conveyance encoder 40 is increased continuously. Because the absolute value of the difference does not exceed the threshold value even at time D, next conveyance operation is executed from time E. If the operation is executed normally, the reference phase of the conveyance roller 9 and the reference phase of the roll sheet R are updated before the conveyance operation is started at time C. However, if the absolute value of the conveyance distance L2 of the sheet drawn out from the roll sheet R is smaller than the absolute value of the value acquired by multiplying the conveyance distance L1 conveyed by the conveyance roller 9 by a coefficient K that is a positive value smaller than 1, the state is determined to be an abnormal state.

$$|K \times L1| > |L2|$$

Alternatively, the state may be determined to be the abnormal state when K×L1>L2 is satisfied.

In the case where the state is determined to be the abnormal state, the reference phase of the conveyance roller 9 and the reference phase of the roll sheet R are not updated. With the operation, the conveyance distance L1 conveyed by the conveyance roller 9 and the conveyance distance L2 of the sheet drawn out from the roll sheet R are calculated cumulatively. With this configuration, a state of the end portion of the roll sheet R can be properly detected even in the case where a subtle conveyance operation is repeatedly executed. In the period from time D to time E, the conveyance distance L1 conveyed by the conveyance roller 9 and the conveyance distance L2 of the sheet drawn out from the roll sheet R also remain unchanged.

Similarly, in the conveyance operation from time E, only the conveyance roller 9 rotates and the absolute value of the difference between the conveyance distance L1 conveyed by the conveyance roller 9 and the conveyance distance L2 of the sheet drawn out from the roll sheet R calculated by the conveyance encoder 40 is increased continuously. The case in which the difference or the absolute value of the difference between the conveyance distance L1 conveyed by the conveyance roller 9 and the conveyance distance L2 of the sheet drawn out from the roll sheet R exceeds the threshold value at time F ($|L1-L2|>T$ or $L1-L2>T$) will be described. At this time, because the absolute value of the conveyance distance L1 is greater than the absolute value of the conveyance distance L2 ($|L2|<|L1|$), the state is determined that the end portion of the roll sheet R is not separable from the paper tube.

Alternately, in a state where the end portion of the roll sheet R is not separable from the paper tube, the roll sheet R cannot rotate. Accordingly, when an amount of change $\Delta L2$ of the conveyance distance L2 in a predetermined period immediately before or slightly before time F is smaller than a predetermined second threshold value T2 ($\Delta L2<T2$), the state may be determined that the end portion of the roll sheet R is not separable from the paper tube.

Further, at the time of multi-pass recording, if a conveyance amount has the minimum value, an amount of change for the LF_POS is small. Thus, an amount of change for the conveyance distance L1 conveyed by the conveyance roller 9 becomes small, and, therefore, a large number of conveyance operations is required until the value reaches the threshold value. Therefore, if the state in which the conveyance distance L2 is smaller than a value acquired by multiplying the conveyance distance L1 by a second coefficient K2 that is a predetermined positive value smaller than 1 ($K2\times L1>L2$) is continued for a predetermined number of times more than twice, the state may be determined to be the non-separable state.

In the case where the state is determined to be the non-separable state during the printing operation, the control unit 301 stops the printing operation and issues a command for notifying the user of the abnormal state. In addition, the control unit 301 displays an indication for prompting the user to set a new roll sheet.

Further, in the case where the driving force of the conveyance roller 9 is not sufficient, the conveyance roller 9 is also stopped in the non-separable state even though the driving force is applied to the conveyance roller 9. In this case, based on a transition of the passage distance of the conveyance roller 9 or information of a diameter value of the roll sheet R, the state may be determined to be the non-separable state.

Figure 11:
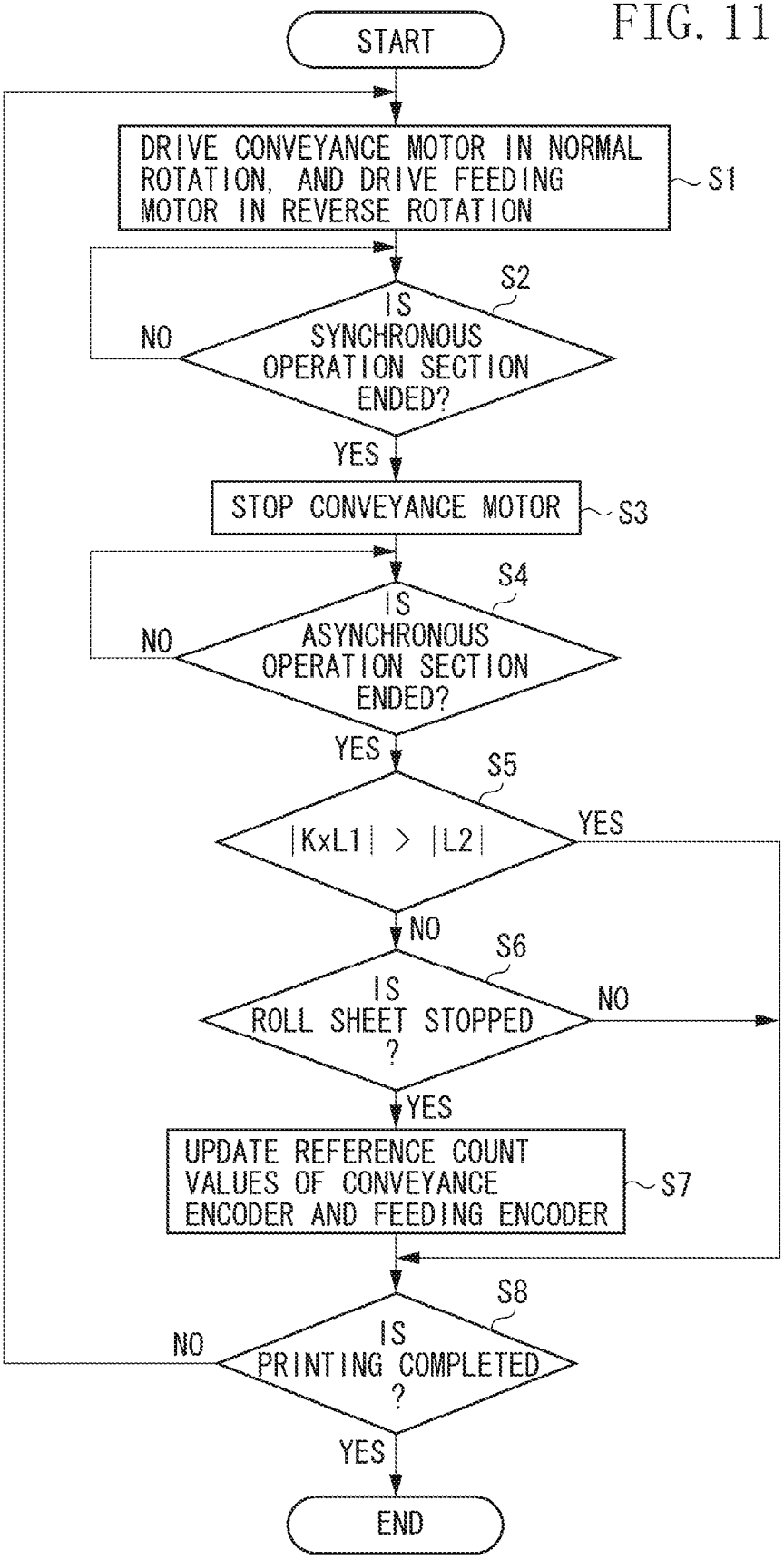
FIG. 11 is a flowchart illustrating an operation for conveying the roll sheet.

FIG. 11 is a flowchart illustrating an operation for conveying the roll sheet R. Step S1 is equivalent to the synchronous operation section. To rotate the conveyance roller 9 in the conveyance direction, the conveyance motor 8 is driven in a normal rotation. To apply a predetermined amount of tension to the sheet between the conveyance roller 9 and the roll sheet R that is set on the feeding unit, the feeding motor 34 is driven in a reverse rotation. In step S2, the control unit 301 determines whether the synchronous operation section is ended. In the case where the control unit 301 determines that the synchronous operation section is ended (YES in step S2), the processing proceeds to step S3. In step S3, the control unit 301 stops the conveyance motor 8 and shifts the operation section to the asynchronous operation section. In the asynchronous operation section, because the feeding motor 34 is driven in a reverse rotation, a loosened portion of the sheet between the conveyance roller 9 and the roll sheet R set on the feeding unit is rewound onto the roll sheet R.

In step S4, the control unit 301 determines whether the asynchronous operation section is ended. In the case where the control unit 301 determines that the asynchronous operation section is ended (YES in step S4) the processing proceeds to step S5. In step S5, the control unit 301 determines whether the absolute value of the conveyance distance L2 of the sheet drawn out from the roll sheet R is smaller than the absolute value of the value acquired by multiplying the conveyance distance L1 conveyed by the conveyance roller 9 by the coefficient K. If the absolute values are $|K\times L1|>|L2|$, as illustrated in FIG. 10, the end portion of the roll sheet R is not separable from the paper tube, so that the roll sheet R may be in a non-rotatable state. If the absolute values are $|K\times L1|>|L2|$ (YES in step S5), the processing proceeds to step S8 without updating the reference count values of the conveyance encoder 40 and the feeding encoder 38. If the absolute values are not $|K\times L1|>|L2|$ (NO in step S5), the processing proceeds to step S6.

In step S6, the control unit 301 determines whether the rotation of the roll sheet R is stopped. If the rotation of the roll sheet R continues, as illustrated in FIG. 9, the end portion of the roll sheet R may be separated from the paper tube, so that the paper tube makes idle rotation. If the rotation of the roll sheet R is not stopped (NO in step S6), the processing proceeds to step S8 without the reference count values of the conveyance encoder 40 and the feeding encoder 38 being updated.

If the rotation of the roll sheet R is stopped (YES in step S6), the processing proceeds to step S7. In step S7, the control unit 301 updates the reference count values of the conveyance encoder 40 and the feeding encoder 38.

In step S8, if the control unit 301 determines that the printing is ended (YES in step S8), the control unit 301 ends the processing. If the control unit 301 determines that the printing is not ended (NO in step S8), the processing returns to step S1.

Figure 12:
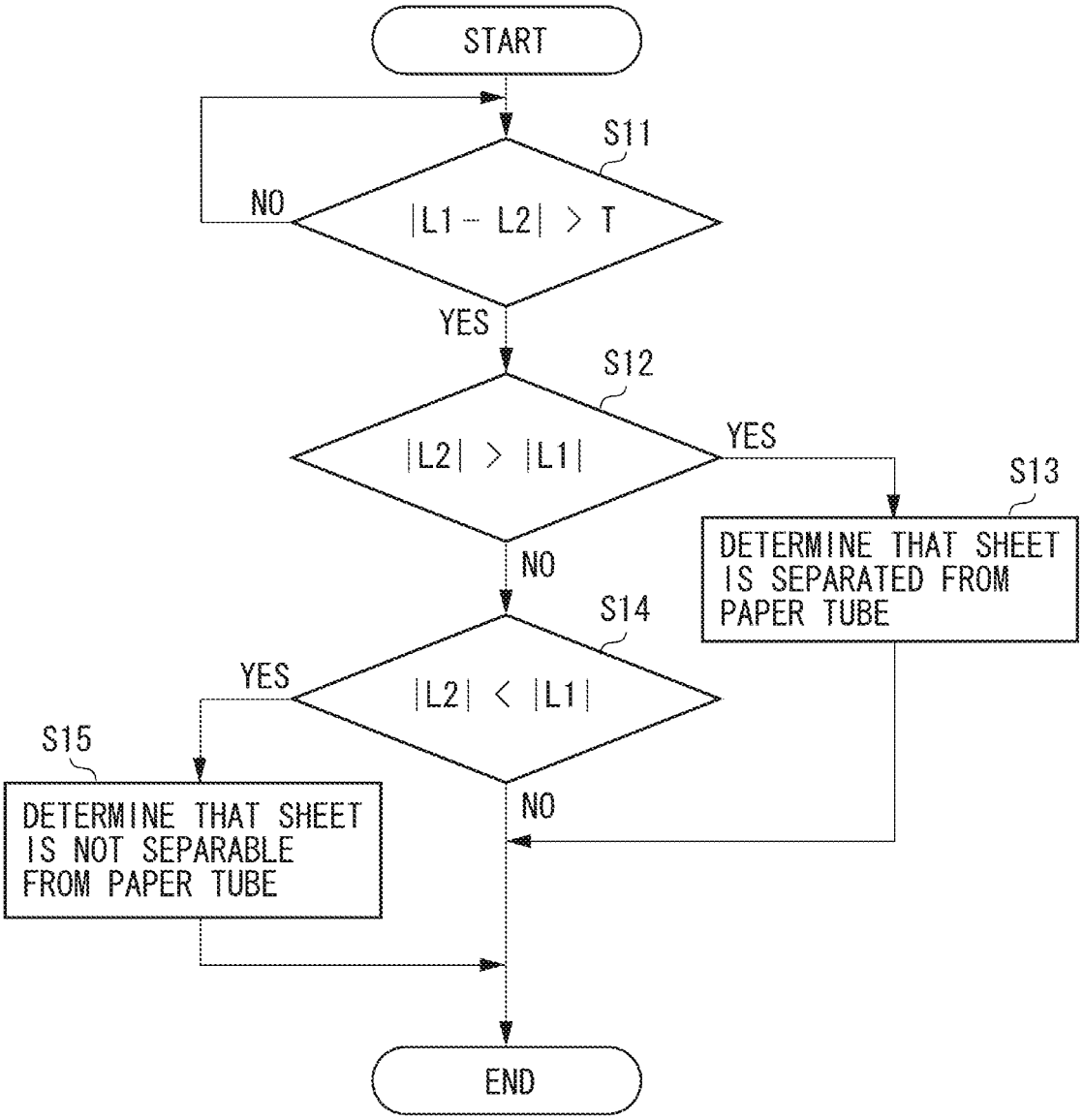
FIG. 12 is a flowchart for determining a state of an end portion of the sheet.

FIG. 12 is a flowchart for determining the state of the end portion of the sheet.

In step S11, the control unit 301 determines whether the absolute value of the difference between the conveyance distance L1 conveyed by the conveyance roller 9 and the conveyance distance L2 of the sheet drawn out from the roll sheet R set on the feeding unit is greater than the predetermined threshold value T. If the absolute value of the difference is greater than the threshold value T ($|L1-L2|>T$) (YES in step S11), the processing proceeds to step S12.

In step S12, the control unit 301 determines whether the absolute value of the conveyance distance L1 conveyed by the conveyance roller 9 is smaller than the absolute value of the conveyance distance L2 of the sheet drawn out from the roll sheet R set on the feeding unit. In the case where the absolute value of the conveyance distance L1 is smaller than the absolute value of the conveyance distance L2 ($|L2|>|L1|$) (YES in step S12), the processing proceeds to step S13. In step S13, the control unit 301 determines that the end portion of the roll sheet R is separated from the paper tube, so that the paper tube makes idle rotation.

In the case where the absolute value of the conveyance distance L1 is not smaller than the absolute value of the conveyance distance L2 (NO in step S12), the processing proceeds to step S14. In step S14, the control unit 301 determines whether the absolute value of the conveyance distance L1 is greater than the absolute value of the conveyance distance L2. In the case where the absolute value of the conveyance distance L1 is greater than the absolute value of the conveyance distance L2 ($|L2|<|L1|$) (YES in step 14), the processing proceeds to step S15. In step S15, the control unit 301 determines that the end portion of the sheet is not separable from the paper tube.

In the above-described exemplary embodiment, the configuration has been described based on the assumption that the conveyance distance L1 of the sheet conveyed by the conveyance roller 9 is equal to the length of the outer circumferential surface of the conveyance roller 9 passing through the nip position between the conveyance roller 9 and the pinch roller 10. However, a distance in which an optional portion of the outer circumferential surface of the conveyance roller 9 moves around the rotational shaft of the conveyance roller 9 (moving distance or moving amount) may be employed as a substitute for the length of the outer circumferential surface of the conveyance roller 9. When the moving amount is employed, the same formula as described above can be used, in which the above-described "L1" is equivalent to the moving amount of the optional portion of the outer circumferential surface of the conveyance roller 9.

Further, the configuration has been described based on the assumption that the length of the continuous sheet drawn out from the roll sheet R is equal to the length of the outer circumferential surface of the roll sheet R passing through a point where the continuous sheet is separated from the roll sheet R. However, a distance in which an optional portion of the outer circumferential surface of the roll sheet R moves around the rotational shaft of the roll sheet R (moving distance or moving amount) may be employed as a substitute for the length of the outer circumferential surface of the roll sheet R. When the moving amount is employed, the same formula as described above can be used, in which the above-described "L2" is equivalent to the moving amount of the optional portion of the outer circumferential surface of the roll sheet R. In addition, another sensor for measuring the moving distance (moving amount) of the continuous sheet drawn out from the roll sheet R may be employed to measure the length of the continuous sheet drawn out therefrom. For example, number of rotations of a driven roller driven and rotated by contacting the drawn-out continuous sheet is detected by using an encoder, and the length of the drawn-out continuous sheet can be calculated from the number of rotations and a radius of the driven roller.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-151405 filed Jul. 5, 2012, which is hereby incorporated by reference herein in its entirety.

What is claimed is:

1. A conveyance apparatus comprising:

a loading portion configured to load a roll sheet wound around a spool shaft;

a feeding unit configured to feed the roll sheet loaded on the loading portion;

a conveyance roller configured to convey a sheet fed from the feeding unit, wherein the conveyance roller being driven in a first direction conveys the sheet downstream;

a control unit configured to perform a first driving operation to drive the feeding unit in a forward direction for feeding the sheet in a direction toward the conveyance roller when the conveyance roller is driven in the first direction, and to perform a second driving operation to drive the feeding unit in a backward direction opposite to the forward direction when the conveyance roller is stopped;

a first detection unit configured to detect a rotation amount of the conveyance roller when the first driving operation and the second driving operation are performed;

a second detection unit configured to detect a conveyance distance of the sheet drawn out from the roll sheet loaded on the loading portion when the first driving operation and the second driving operation are performed; and a determination unit configured to determine whether an end portion of the roll sheet is fixed to the spool shaft, based on detection result by the first detection unit and the second detection unit.

2. The conveyance apparatus according to claim 1, further comprising:

a conveyance motor configured to drive the conveyance roller; and a conveyance encoder configured to detect a rotation amount of the conveyance motor, wherein the first detection unit detects, using the conveyance encoder, the rotation amount of the conveyance roller.

3. The conveyance apparatus according to claim 1, further comprising:

a first code wheel configured to rotate in synchronization with the conveyance roller; and a first count unit configured to count a mark or a slit provided on the first code wheel.

4. The conveyance apparatus according to claim 1, further comprising:

the spool shaft inserted in the roll sheet;

a feeding motor configured to drive the spool shaft; and a feeding encoder configured to detect a rotation amount of the feeding motor, wherein the second detection unit detects, using the feeding encoder, the conveyance distance of the sheet drawn out from the roll sheet.

5. The conveyance apparatus according to claim 4, further comprising:

a second code wheel configured to rotate in synchronization with the feeding motor; and a second count unit configured to count a mark or a slit provided on the second code wheel.

6. The conveyance apparatus according to claim 4, further comprising a measurement unit configured to measure an outer diameter of the roll sheet, wherein the second detection unit detects, using the feeding encoder and the measurement unit, the conveyance distance of the sheet drawn out from the roll sheet.

7. The conveyance apparatus according to claim 1, wherein the determination unit determines whether the end portion of the roll sheet is close.

8. A recording apparatus comprising:

a loading portion configured to load a roll sheet wound around a spool shaft;

a feeding unit configured to feed the roll sheet loaded on the loading portion;

a conveyance roller configured to convey a sheet fed from the feeding unit, wherein the conveyance roller being driven in a first direction conveys the sheet downstream;

a recording unit configured to perform recording on the sheet conveyed by the conveyance roller;

a control unit configured to perform a first driving to drive the feeding unit in a forward direction for feeding the sheet in a direction toward the conveyance roller when the conveyance roller is driven in the first direction, and to perform a second driving to drive the feeding unit in a backward direction opposite to the forward direction when the conveyance roller is stopped;

a first detection unit configured to detect rotation amount of the conveyance roller when the first driving operation and the second driving operation are performed;

a second detection unit configured to detect a conveyance distance of the sheet drawn out from the roll sheet loaded on the loading portion when the first driving operation and the second driving operation are performed;

a determination unit configured to determine whether an end portion of the roll sheet is fixed to the spool shaft, based on detection result by the first detection unit and the second detection unit.

9. The recording apparatus according to claim 8, further comprising a carriage, on which the recording unit is mounted, configured to move in a direction orthogonal to a conveyance direction of the sheet.

10. The recording apparatus according to claim 8, further comprising:

a conveyance motor configured to drive the conveyance roller; and a conveyance encoder configured to detect a rotation amount of the conveyance motor, wherein the first detection unit detects, using the conveyance encoder, the rotation amount of the conveyance roller.

11. The recording apparatus according to claim 8, further comprising:

a first code wheel configured to rotate in synchronization with the conveyance roller; and a first count unit configured to count a mark or a slit provided on the first code wheel.

12. The recording apparatus according to claim 8, further comprising:

the spool shaft inserted in the roll sheet;

a feeding motor configured to drive the spool shaft; and a feeding encoder configured to detect a rotation amount of the feeding motor, wherein the second detection unit detects, using the feeding encoder, the conveyance distance of the sheet drawn from the roll sheet.

13. The recording apparatus according to claim 12, further comprising:

a second code wheel configured to rotate in synchronization with the feeding motor; and a second count unit configured to count a mark or a slit provide on the second code wheel.

14. The recording apparatus according to claim 8, wherein the determination unit determines whether the end portion of the roll sheet is close.

* * * * *